United States Patent [19]

Doyle

[11] Patent Number: 4,736,950

[45] Date of Patent: Apr. 12, 1988

[54] HANDGRIP

[76] Inventor: Tom Doyle, 907 Baltimore, El Paso, Tex. 79902

[21] Appl. No.: 810,779

[22] Filed: Dec. 19, 1985

[51] Int. Cl.[4] ..... A63B 49/08

[52] U.S. Cl. ..... 273/75

[58] Field of Search ..... 273/25, 670 A, 81 R, 273/81 B, 81 P, 73 J, 72 R, 81.4, 81.5, 81.6, 165, 75, 68; D21/222; 74/551.9

[56] References Cited

U.S. PATENT DOCUMENTS

| | | | |
|---|---|---|---|
| 1,664,971 | 4/1928 | Dean | 273/68 |
| 2,131,966 | 10/1938 | Nelson | 273/81 R |
| 2,523,637 | 9/1950 | Standfield et al. | 273/75 |
| 3,173,689 | 3/1965 | Serblin | 273/81 R |
| 3,295,850 | 1/1967 | Garrity | 273/81 B |
| 3,436,079 | 4/1969 | Berry et al. | 273/68 |
| 3,441,276 | 4/1969 | Garrity | 273/81.4 |
| 3,817,521 | 3/1972 | Wright | 273/75 |
| 3,868,110 | 11/1972 | Jones | 273/75 |
| 4,072,311 | 2/1978 | Bertucci | 273/75 |
| 4,402,508 | 12/1981 | Pflueger | 273/75 |

FOREIGN PATENT DOCUMENTS

| | | | |
|---|---|---|---|
| 2232337 | 3/1975 | France | 273/75 |
| 18540 | of 1895 | United Kingdom | 273/75 |

*Primary Examiner*—Richard C. Pinkham
*Assistant Examiner*—T. Brown
*Attorney, Agent, or Firm*—Thomas L. Crisman

[57] ABSTRACT

An anatomically configured racket grip which includes a rotationally symmetrical gripping surface having a uniform midsection whose length is approximately its cross-sectional dimension, an upper transition region varying the cross-sectional dimension from that of the uniform midsection to that of the racket shaft, and a lower transition region varying the dimension from that of the uniform midsection to a reduced cross-sectional dimension. The hand while grasping the improved grip has improved surface area contact therewith, has the muscles thereof positioned near their resting position for optimal exercise of force and control, and the pressure against the regions of the hand which can cut off circulation to the tissues of the hand is minimized to reduce fatigue resulting from use of the grip.

10 Claims, 4 Drawing Sheets

HANDGRIP

BACKGROUND OF THE INVENTION

1. Field of the Invention

The invention relates to a hand grip structure, and more particularly, to an anatomically configured hand grip for optimum transfer of prehensile forces to a gripped implement.

2. History of the Prior Art

The human hand is the principal means by which man grasps, lifts, and manipulates objects. Man uses his hand to hold objects in one of two general fashions. The first has been termed a precision grip. With this grip, primarily the fingers of the hand are involved and objects requiring very precise manipulation such as pencils, surgical scalpels, and other instruments are used. The other type of grip is referred to as a power grip and is one by which man grasps objects over which he desires to exert a maximum amount of power and force. Generally speaking, the shape of the object handled by the hand has very little to do with the type of grip employed and virtually all prehensile movements of the hand, wherein the object of the movement is to exert power and force over the object held involves the power grip.

Many different implements are intended to be grasped and moved by the hand and arm so as to effect some result. These implements include everything from tools such as hammers, axes and screw drivers to sporting equipment such as tennis rackets, golf clubs and baseball bats. With each of these implements one of the primary functions of its use is to move the implement with a substantial amount of power being exerted thereover.

In racket sports such as tennis, racketball and squash, it is desirable to move the racket with the hand and arm so as to exert a maximum amount of power and precision over the movement of the racket. This should be done while minimizing the fatigue in the hand and arm resulting from such movements. All of the force which is exerted over an implement such as a racket must travel through the portion of the racket handle which is grasped by the hand and conventionally known as the grip of the racket. Most conventional grips are generally uniform in cross section throughout their length. The grips normally have a cross-sectional shape which is generally circular, oval, or of some other regular shape (e.g. octagonal). In addition, such grips are usually wrapped with either strips of leather or some other nonslip material to improve the ability of the hand to grasp the surface and maximize the power and control which can be exerted over the implement.

In the power grip the object is held in the hand. If the object is elongate, it is generally placed axially along the palmar flexion creases with the thumb folded around in one direction and the fingers folded around in the other. In the power grip, the thumb and either the index or middle finger are in opposition to one another with the ring finger and little finger grasped tightly around the periphery of the object.

Grips of conventional uniform cross section along their length do not allow the hand to be postured in its most anatomically correct configuration so as to maximize either the power or the precision of movement exercised over the implement. Most implement grips are designed according to tradition rather than according to anatomical/physiological considerations and traditional designs do not necessarily provide the highest design/function relationship. In addition, the hand often tires quickly from repeated movement using such a uniform grip. Prior art implement grips such as those for tennis rackets, have been designed for improvement of the gripping surface to maximize utilization of the implement. In particular, U.S. Pat. No. 3,905,589 to Ballog discloses an improved tennis racket hand grip wherein the gripping surface is contoured to conform to the hand, and particularly the shape of the fingers and thumb, when held in a power grip. The Ballog patent includes contours on the gripping surface to receive the digits of the hand in both a forehand and backhand posture and specific indentations and recesses are formed in the gripping surface to receive the fingers and thumb in each of these two configurations. U.S. Pat. No. 3,868,110 to Jones discloses a similar approach to the improvement of tennis racket grips which also includes distinct indentations to receive the contours of the thumb and fingers in both the forehand and backhand positions. Increasing the surface area of interengagement between the hand and the grip increases the power which can be exerted over the implement. The intent of each of these two prior art patents is to use the finger recesses to maximize the surface area of contact between the hand and the grip in order to maximize the amount of strength and power which can be exerted over the racket by the arm and hand. However, increasing the amount of surface contact between the grip and the hand also increases the amount of compression of the tissues of the hand, thumb and fingers which restricts the blood supply thereto and reduces the delivery of oxygen to the muscles and other tissues of the hands. This increases the rate at which the hand fatigues and decreases the time period over which the hand can continue to exert a maximum amount of strength and power over the implement.

An additional disadvantage of prior art finger indentation grips is that hand sizes are all slightly different. Moreover, the precise hand posture which each player assumes in a forehand and in a backhand grip of the racket is also slightly different and does not necessarily conform to the precise configurations which are included in contoured prior art grips. Misalignment of the contoured surface of the hand creates even greater mismatch between the hand surface and the grip which degrades rather than increases the amount of power and precision of control over the racket.

It may also be seen that the contoured gripping surfaces of the prior art are only suitable for implements such as tennis rackets wherein the device is always used with a fixed position of rotation about the axis of the grip. That is, for implement handles where there must be the ability to grip the handle at any position of rotational symmetry, contoured grips are totally ineffective.

The grip of the present invention is rotationally symmetrical, permitting the hand to grasp the grip in a posture which improves the power and control which can be exerted over the implement. This is effected by allowing the hand to assume a position wherein each of the muscles which control movement of the fingers is in its resting position and thus able to exert maximum force over the grip. In addition, the grip of the present invention allows the hand to transfer a maximum amount of force through the fleshy portion of the hand located between the thumb and the forefinger. This requires little force to be exerted by the portion of the hand which overlies the metacarpal tunnel through which numerous veins, arteries, nerves and tendons controlling movement of the hand pass. Blood flow is thus not restricted and needless pressure is not applied to the nerves in that region. These features allow the hand to continue to apply a maximum amount of force and control over the grip without tiring due to a restricted flow of blood to the muscles and other tissues of the hand.

SUMMARY OF THE INVENTION

The present invention pertains to an improved implement grip. More particularly one aspect of the invention includes an elongate, substantially rotationally symmetrical grip having a generally uniform midsection for contact with the hand in the region between the thumb and the forefinger. The grip is formed with a tapered upper section transisting from the cross-sectional dimension of the uniform midsection to the cross-sectional dimension of the implement attached to the grip. A lower section tapers from the cross-sectional area of the uniform midsection down to a relatively narrower region extending beyond the lower edge of the hand surface and joins a radially extending phalange portion of a slightly greater cross-sectional area forming the lower end of the grip.

In another aspect, the invention includes an improved grip for an implement to be used in the power grip posture of the human hand. The grip comprises an elongate surface for engagement by the parts of the hand and includes a generally uniform midsection for engaging the region between the thumb and the forefinger. The uniform midsection has a diameter to posture the thumb and the forefinger in opposition when wrapped about the handle. A generally upper tapering region transists the cross section dimension from the uniform midsection to the diameter of the implement attached to the upper transition regions. A lower tapering region transists from the uniform midsection a distance sufficient to provide a surface for contact with the fingers of the hand and which tapers to a cross-sectional dimension smaller than that of the uniform midsection so that when the fingers when the fingers are wrapped about the lower transition region they are all postured with their muscles near their resting lengths. In another aspect the grip also includes a radially extending phalange region affixed to the lower transition region to provide sensory tactical orientation for the heel of the hand with respect to the grip.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION OF THE PREFERRED EMBODIMENT

Figure 1A:
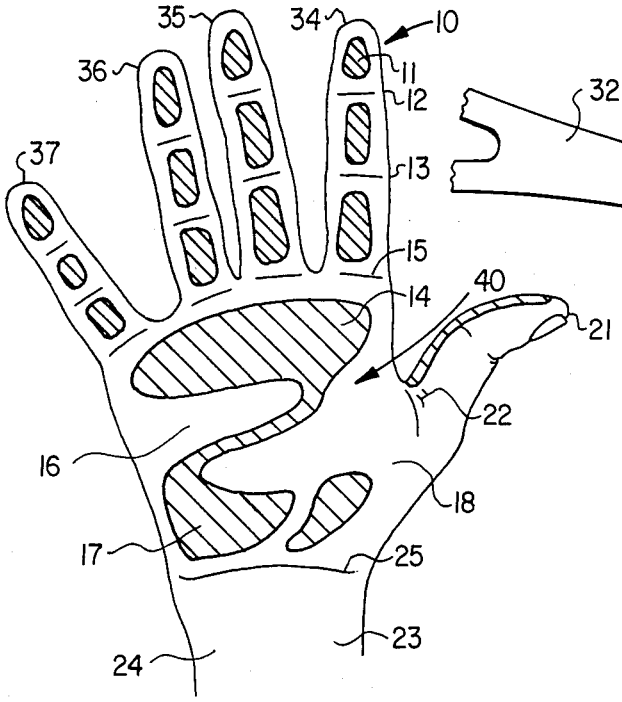
FIG. 1A is a view of the palmar surface of the hand wherein the shaded area represents the portion of the hand which contacts a cylindrical object of the prior art held in the power grip posture.

Referring first to FIG. 1A, there is shown a plan view of an open right hand. The several regions of the hand include the digital pads 11 or fingertips which are pulpy and adjust themselves to the shape of whatever is being gripped by the hand. Each finger consists of three segments joined by interphalangeal joints 12 and 13 and which are connected to the volar region 14 of the hand by means of metacarpal-phalange joints 15. Flexion of the metacarpal-phalange joint is greatest in the little finger and least in the index finger. Other principal features of the hand include flexion creases in the region 16 which are skin folds or hinges and allow bending of the hand. The hypothenar eminence 17 also referred to as the heel of the hand acts as a muscular buttress to reinforce the power of the hand in the grasping of objects.

The thenar eminence 18, or ball of the thumb, comprises a series of small muscles which acting together produce rotation of the thumb and together with the index finger produce the movement of "opposition", the most precise function of which the human hand is capable and which is a major aspect of the power grip. The thumb 21 is joined to the ball region 18 by a metacarpal-phalange joint 22. The hand is joined to the two bones comprising the forearm, the two bones of which are the radius in the region 23 and the ulna in the region 24 by means of a carpo metacarpal joint 25.

Figure 1B:
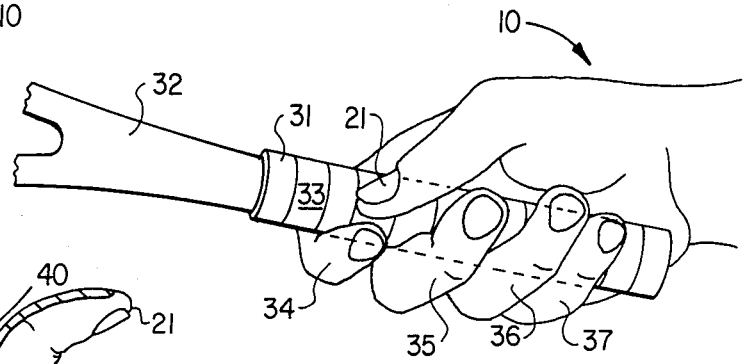
FIG. 1B (PRIOR ART)
FIG. 1B illustrates a prior art racket grip of generally uniform cross section being held by a hand in the power grip posture.

Referring next to FIG. 1B, the hand 10 is shown grasping a conventional prior art grip 31 which may comprise the handle to a playing implement such as a tennis racket 32. As illustrated, the grip 31 is of the traditional variety in which the grip is generally uniform in cross section along its length and wrapped by spiral strips of material 33 to provide a more reliable gripping surface. The hand 10 is shown grasping the grip 31 in the power grip configuration illustrating the manner in which the index finger 34 and the thumb 21 are in "opposition" to one another. This capability is unique to man among the primates and characterizes man's ability to assume a power grip posture over objects. As can be seen in FIG. 1B, each of the middle finger 35, the ring finger 36, and the little finger 37 are flexed about their metacarpal-phalange joints so as to encircle the grip 33 for maximum contact between the hand and the object.

Referring back to FIG. 1A, the shaded areas shown in the view of the hand 10 presented there illustrate the areas of contact of the hand with an object in the power grip posture such as the grip 31. The thumb contacts the object in extended position at the carpo metacarpal joint or covers the dorsum of the fingers flexed over the object. The contact areas consist of part of the palm and the almost full length of the volar region 14 and slight radial aspects of the fingers. In addition, contact is on the volar aspect of the thumb which may be either slightly radial or slightly ulnar. As noted, the contact between the grip 31 and the surface of the hand is somewhat limited particularly in the less sensitive areas which are ideal for large contact surfaces and for distributing force over large areas, such as the tough tissue in the regions 40 between the thumb 21 and the index finger 34.

Figure 2A:
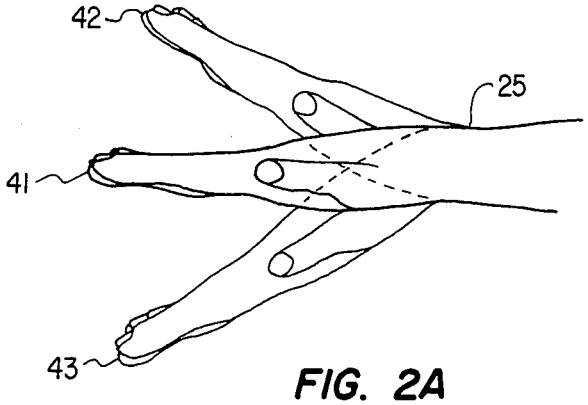
FIG. 2A illustrates movement of the hand about the wrist joint in one axis showing dorsiflexion, neutral position, and palmar flexion.
Figure 2B:
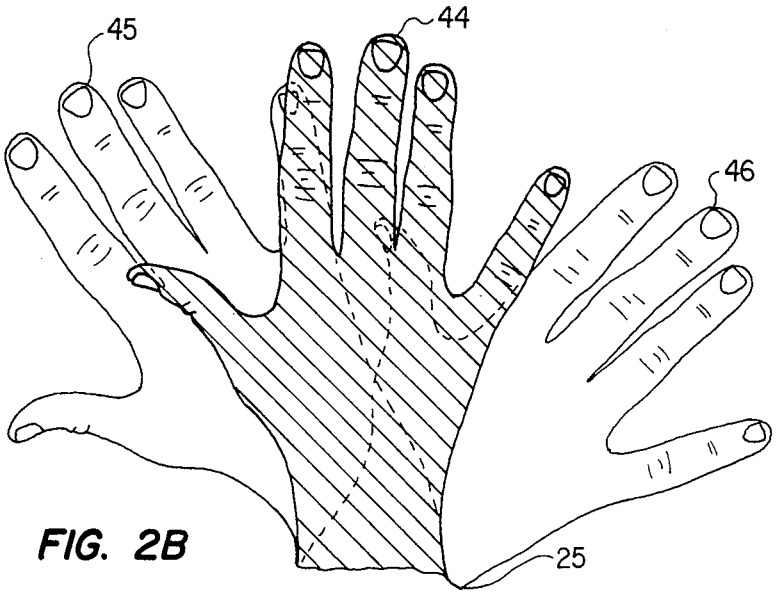
FIG. 2B illustrates movement of the hand about the wrist joint along its other axis and orthogonal to the movement illustrated in FIG. 2A illustrating radial deviation, neutral position, and ulnar deviation.

Referring next to FIGS. 2A and 2B, the hand is free to move about the carpo metacarpal wrist joint 25 in only two planes. First, referring to FIG. 2A, there is shown an overlay drawing illustrating movement of the hand through approximately 90 degree in one plane from the neutral position 41 upwardly into the dorsiflexion position 42 and downwardly into the palmar flexion position 43. Similarly, FIG. 2B shows deviation of the hand in the other orthogonal plane from a neutral position 44, shown in shaded lines, toward a full radial deviation illustrated at 45 in one direction and full ulnar deviation 46 in the other direction. Hand/wrist orientation and movement through the carpo metacarpal joint 25 is important in the gripping of any object by the hand.

Figure 3:
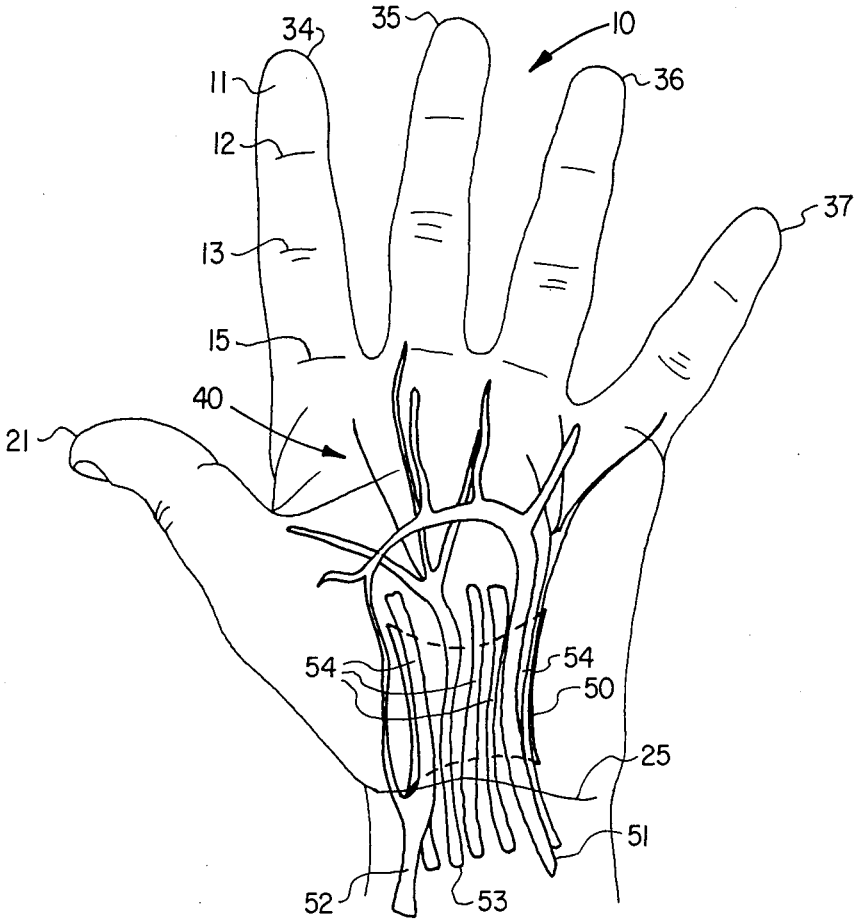
FIG. 3 is a illustration of a palmar view of a left hand showing the anatomical construction of the carpal tunnel region illustrating the blood vessels, tendons, and nerves passing therethrough.

Referring now to FIG. 3, there is shown a open palm view of a left hand which schematically illustrates the structure known as the carpal tunnel 50. This structure passes through the wrist into the hand wherein virtually all of the arteries, nerves, and tendons which feed nutrients to the muscles of the hand must pass and through which control the actuations thereof must pass. Some of these include the ulnar artery 51 and the radial artery 52, the median nerve 53 and the ulnar nerve 54 along with numerous tendons 54. When the wrist 25 is straight, each of the arteries, nerves, and tendons operate freely through the carpal tunnel 54 and the muscles of the hand all work properly. However, if the wrist is bent and especially in either palmar flexion or ulnar deviation, serious problems occur in the function of the hand. The tendons 54 bind and bunch up in the carpal tunnel which leads to inflammation of the tendon sheaths. In addition, this bunching of the tendons also compresses vascular and nerve structures disrupting their normal function which prevents the flow of information through the nerve members to restrict actuation of the muscles and which also restricts the flow of blood to the muscle fibers bringing in oxygen and carrying away waste products so as to prevent fatigue from developing in the hand. Thus, it is very important to maintain grip over an object whereby the wrist joint is held in a straight position.

Any grip which must be squeezed to maintain grasping control thereover, concentrates considerable compressive force in the palm of the hand. There are particular pressure sensitive areas in the palm including those areas overlying the critical blood vessels and nerves and especially the ulnar and radial arteries 51 and 52. Obstruction of the blood flow through these arteries, know as ischemia, leads to numbness and tingling of the fingers and overall weakness and rapid fatigue in the hand. This produces degradation of the force of the power grip. Thus, an optimally configured anatomical grip should be designed to provide large contact surfaces over which to distribute the force between the grip and the hand and so as to direct it into less sensitive areas such as the tough tissue in the region 40 between the thumb 21 and the index finger 34.

The actual gripping force which can be exerted by the hand in the power grip posture is a property of the combined activity of the muscles of the hand. The length of the muscle at which the active tension capable of being exerted thereby is maximal is referred to as its "resting length". The term refers to early experiments which demonstrated that the length of many of the muscles in the body at rest is the length at which they develop maximal tension in response to stimulation toward contraction. This phenomenon is a factor of the specific properties of the contractile proteins which make up the skeletal muscles in the body including those which control the movements of the hand.

Figure 4:
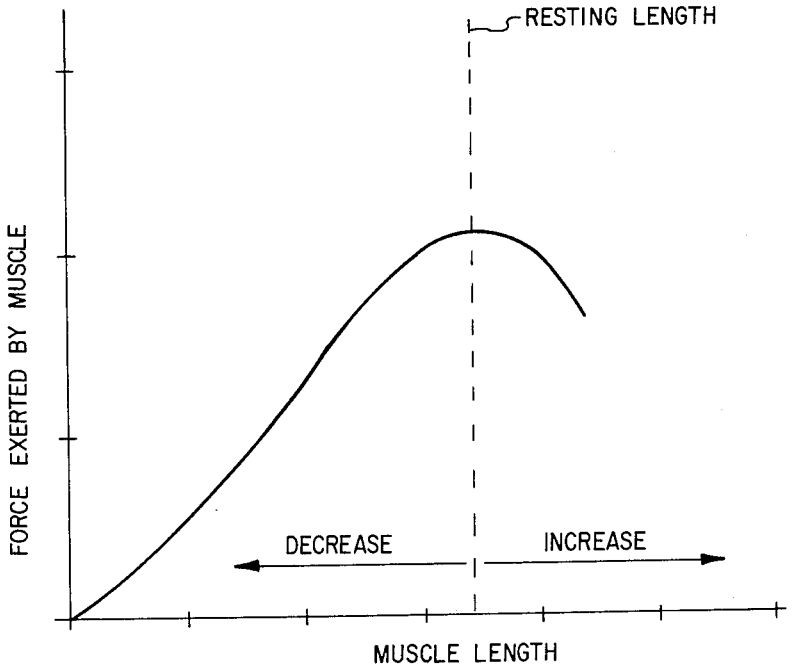
FIG. 4 is an illustrative graph showing the manner in which maximum muscular tension is exerted about the resting position of the muscle.

Referring next to FIG. 4, there is shown an illustrative graph of the relationship between the force which can be exerted by a muscle and its length. As can be seen, when a muscle is compressed, its force is very low. The force rises as it approaches a length known as the resting length, at which point the force to be exerted by the muscle is at a maximum. Continuing to increase the length of the muscle beyond its resting length results in a rapid decrease in its strength and the force which it can exert over a load. Thus, it can be seen that by constructing an anatomically configured grip so that the muscles which control each of the fingers of the hand are positioned and postured so that as many muscles as possible are in their resting length. The muscles, therefore, are able to exert a maximum amount of force and control over the grasping of the implement. In this manner maximum power can be manifested by means of the power grip.

An anatomical/physiological relationship exists such that when the hand is circumferencing a shaft in the power grip, the gripping potential of the hand is optimum when the hand wraps comfortably around the grip without having to unduly squeeze at either the large or the small extreme of the grip in order to maintain proper gripping posture. The grip design of the subject invention utilizes the optimization of anatomical/physiological considerations in order to configure the grip dimensions which yields the most functional and efficient performance in the power grip posture.

Figure 5A:
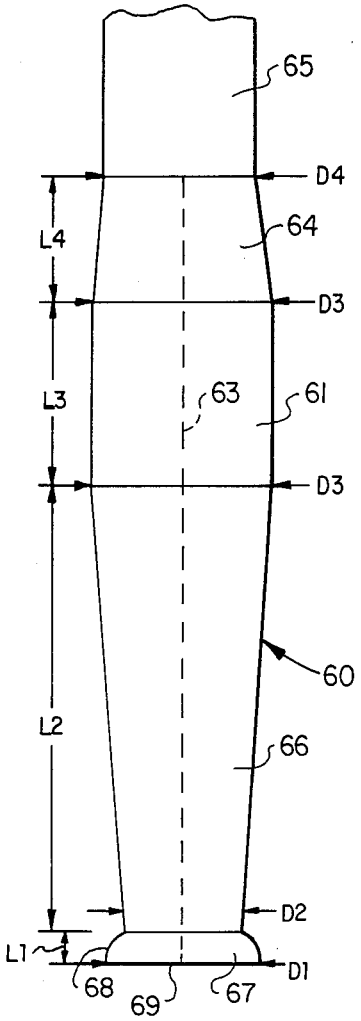
FIG. 5A shows a side elevational view of an anatomically configured grip constructed in accordance with the teachings of the present invention.

Referring next to FIG. 5A, there is shown a side plan view of the grip 60 constructed in accordance with the principles of the present invention. The grip comprises a generally uniform midsection 61 having a transverse cross-sectional dimension of D3. The length of the uniform midsection in the direction along the axis of the grip 63 is approximately the same as the cross-sectional dimension D3. The uniform midsection 61 is connected at its upper end to a tapered upper transition region 64 which transists the cross-sectional dimension from D3 down to a dimension D4 where it is connected to the implement shaft 65 such as that of a tennis racket. Although the side walls of the upper transition region 64 have been shown in the form of a truncated section generally in the form of a truncated cone, it should be understood that other shapes are possible and the general principle is that of a taper from the cross-sectional dimension D3 of the uniform midsection 61 to the cross-sectional dimension of the implement to which the grip is attached. The lower end of the uniform midsection 61 is connected to an elongate lower tapered region 66 which transists from the cross-sectional dimension D3 of the uniform midsection 61 down to a smaller cross-sectional dimension D2 at which it joins a flared base region 67 having a slightly larger cross-sectional dimension D1. It should also be understood that the lower tapered region 66 also has been shown in the form of a generally truncated cone, however, other configurations are fully within the scope of the teachings of the present invention. The flared base region 67 is intended mainly to provide a tactically sensed orientation surface so that one knows where the hand is located along the longitudinal axis 63 of the grip 60. The base region 67 has rounded edges 58 and is shown as having a flat bottom 69 though other configurations are possible. As noted in the end view, FIG. 5B, the cross-sectional dimension D1 is greater than D2 but less than D3.

The region comprising the uniform midsection 61, having a cross-sectional dimension D3, also has a length dimension L3. The upper transition region 64, having a taper from the cross-sectional dimension D3 of the uniform midsection 61 down to the cross-sectional dimension D4 of the implement 65, has longitudinal dimension L4. Similarly, the lower transition region 66, tapering from the cross-sectional dimension D3 of the uniform midsection 61 down to the cross-sectional dimension D2, has a length dimension L2. Finally, the terminal section 67 which transists from the dimension D2 to the larger flared cross-sectional dimension D1 has a length dimension L1.

Figure 5C:
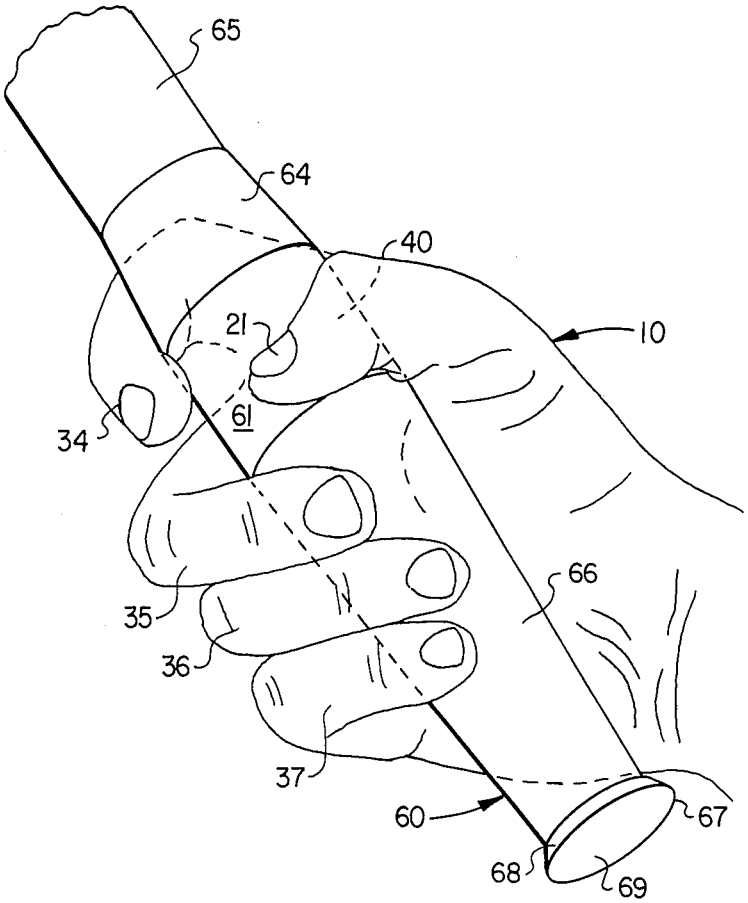
FIG. 5C shows an illustrative perspective view of the grip of the present invention being held by a hand in the power grip posture illustrating the advantages and features thereof.
Figure 5B:
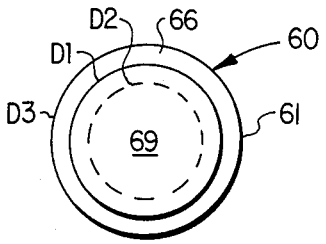
FIG. 5B shows an end view of the grip shown in FIG. 5A.

Referring now to FIG. 5c, it is there shown how a hand might grasp the improved grip of the invention in the power grip posture and obtain maximum anatomical/physiological interaction with the implement 65 through contact with the grip 60. As shown, the uniform midsection 61 is positioned in abutment with the padded fleshy region 40 between the thumb and the forefinger and the thumb 21 is wrapped around the uniform midsection to be comfortably in opposition with the index finger 34 and/or the middle finger 35 depending upon the preference of the user. The index finger 34 is folded around the grip 60 and rests generally along the side walls of the upper transition region 64 and is readily movable and easily reorientable in its association with that region as required. For example, in the connection with a forehand and a backhand grip of a tennis racket such movement is often necessary. The general radial symmetry of the grip 60 allows full rotation of the grip about its central axis but at the same time maximizes the amount of contact which exists between the surface of the hand and fingers and the grip surface itself.

The main force bearing interface between the hand and the grip 60 is between the uniform midsection 61 and the fleshy/pulpy region 40 in the area between the thumb and the index finger which does not contain a substantial amount of nerves, tendons, or blood vessels which are particularly sensitive to decreases in circulation. The middle finger 35, the ring finger 36, and the little finger 37 is each wrapped spirally about the lower tapered region 66 to come into enhanced surface area contact with the grip 60 while at the same time posturing the degree of flexture of the metacarpal/phalange joints of each of these three fingers so that the muscles which control movement of the fingers ar optimally configured in the resting positions. In this manner, they are capable of exerting maximum force over the gripping action between the fingers and the grip itself. Although there is extensive physical contact in the palmar regions of the hand, there is very little force bearing engagement there so as not to restrict the free passage of nerves, tendons, and arteries through the carpal tunnel and restrict the flow of blood or the movement of muscles or tendons therein. The lower edge of the transition region 66 bears against the hypothenar eminence and the thenar eminence portions of the hand for enhanced contact with reduced restriction of blood flow or tendon movement within the hand. The base region 67 may be contacted by the lower edge of the hypothenar eminence to provide a tactically sensed orientation of the hand with respect to the grip 60 as the grip is being grasped by the hand.

With respect to actual cross-sectional areas of the grip 60, it should be recognized that there are certain variations between sizes of hands. However, anthropometric measurement data show that the measurement of the lengths of the different portions of the hands are surprisingly uniform. For example, 99 percent of male hands vary only 0.75 inches in length from a median of 7.5 inches and 67 percent of these hands vary only 0.34 inches in length. Male hand width at the metacarpal joints varies by only 0.40 inches in 99 percent of the male population. The actual physical size of the grip is much less significant than the unique anatomical configuration of the grip of the subject invention. While several sizes might be provided for ideal mating with variation in hand size, for example between men and women and children these variations are insignificant with regard to the significance of the proportional variations in the individual parts of the grip.

While the actual dimensions of the subject grip are less important and may be varied as desired, there are proportions between the restrictive parts of the grip which are preferable. Certain relationships between the various dimensions have been found to be optimal for construction of the grip of the subject member. With regard to the dimensions D1–D4 and L1–L4 the following various relationships between these dimensions have been found to be helpful in constructing a grip with optimal dimensions for maximizing the utilization of the power grip.

$$L_3 = D_3 \quad (1)$$

$$\frac{D3}{D_2} = \frac{3}{2} \quad (2)$$

$$\frac{D_2}{D_1} = \frac{3}{4} \quad (3)$$

$$\frac{L3}{L2} = \frac{3}{8} \quad (4)$$

$\frac{D3}{D2}$ is equal to $K \times L3/L2$, where $K$ is approximately equal to 4; (5)

-continued $D4$ is equal to the diameter of the implement shaft; (6)

$L4$ equals approximately 1 inch; and (7)

$L1$ equals approximately one-quarter inch. (8)

It should also be understood that the above specific ratios of dimensions are based upon a generally circular cross-sectional configuration of the subject grip. It should be clearly understood that other cross-sectional dimensions are clearly contemplated within the subject invention, including, oval, octagonal, hexagonal, ovoid, and other different regular and irregular geometrical configurations. The ratios given above may be related to other non circular geometrical grip configurations such as octagonal or oval where it is said the ratio of L3/L2 is proportional to D3/D2 it means the circumferencial dimension at D3 when D3 is from a circular configuration and D2 is measured in a circular configuration.

Figure 6A:
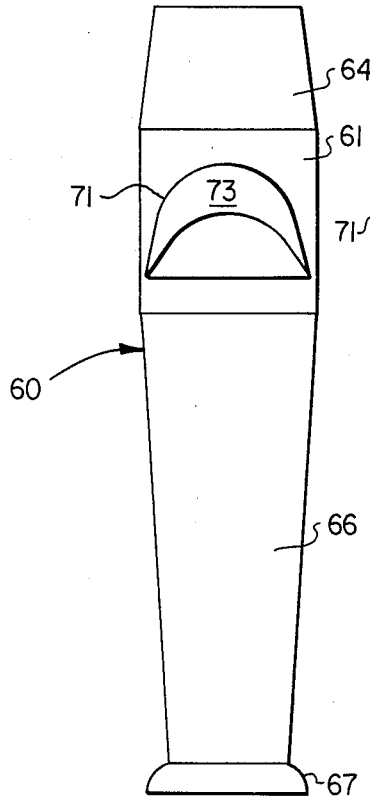
FIG. 6A illustrates a front plan view of an alternate embodiment of the grip of the present invention.
Figure 6B:
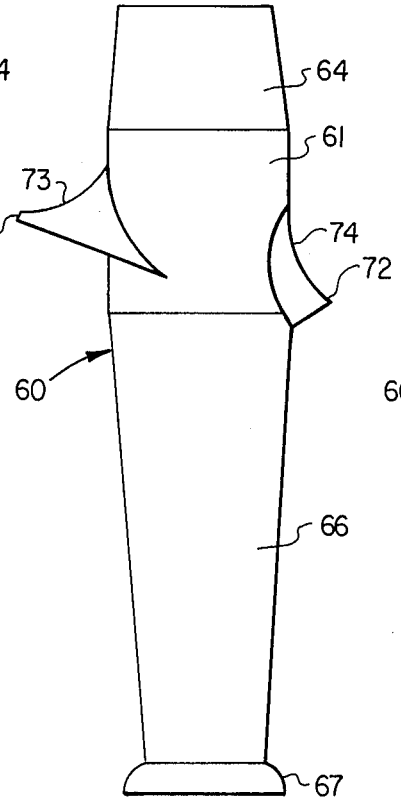
FIG. 6B shows a left side view of the alternate embodiment of the grip shown in FIG. 6A.
Figure 6C:
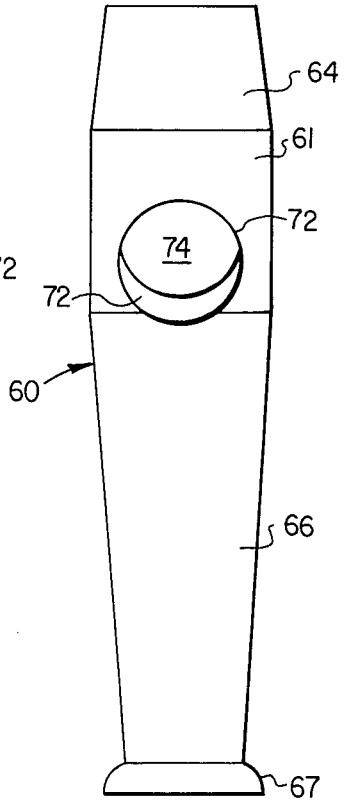
FIG. 6C shows a right side view of the grip of the alternate embodiment of FIG. 6A.

Referring now to FIGS. 6A–6D, there is shown an alternate embodiment of the grip design of the subject invention which relates to the additional consideration of grip control. Since the human fingers do not completely oppose a thumb counterpart at every digit, and thus cannot provide the theoretically maximum prehension capability, two additional phalanges may be incorporated into the grip as optional or movable structures. As shown in FIG. 6A, a top plan view of an anterior phalange 71. FIG. 6C shows a top plan view of a posterior phalange 72. FIG. 6B shows a side view of each of the two phalanges 71 and 72. The anterior phalange 71 is positioned along and near a central portion to protrude radially outwardly from the uniform midsection 61 for engagement with index finger. The lower surface of the phalange 71 is generally straight and extends out from the sidewall of the uniform midsection 61 at an angle which may be in the range of 10–30 degrees. The superior surface 73 of the anterior phalange is preferably concave for conforming to the hand surface through the digital pad of the index finger. The angle with which the upper edge of the superior surface 73 intersects the sidewall of the uniform midsection 61 is also the order of 10–30 degrees. The longitudinal position of the anterior phalange 71 may be adjusted longitudinally to positions approximately $\frac{1}{8}$ inch above the midsection of the central portion of the uniform midsection 61 and in $\frac{1}{8}$ inch increments to approximately $\frac{1}{4}$ inch below the midsection thereof.

The posterior phalange 72 is positioned to extend radially outwardly from the uniform midsection 61 at a diametrically opposite position from the anterior phalange 71. The superior surface 74 of the posterior phalange 72 is also concave to receive the digital pad of the thumb region. The lower linear edge 76 of the posterior phalange 72 preferably forms an angle of approximately 10–60 degrees to the axis of the grip. The posterior phalange may similarly be moved in the longitudinally direction in $\frac{1}{8}$ inch increments from approximately $\frac{1}{8}$ inch above the central portion of the uniform midsection 61 to approximately $\frac{1}{4}$ inch below the midsection of the middle portion of the uniform midsection 61.

Figure 6D:
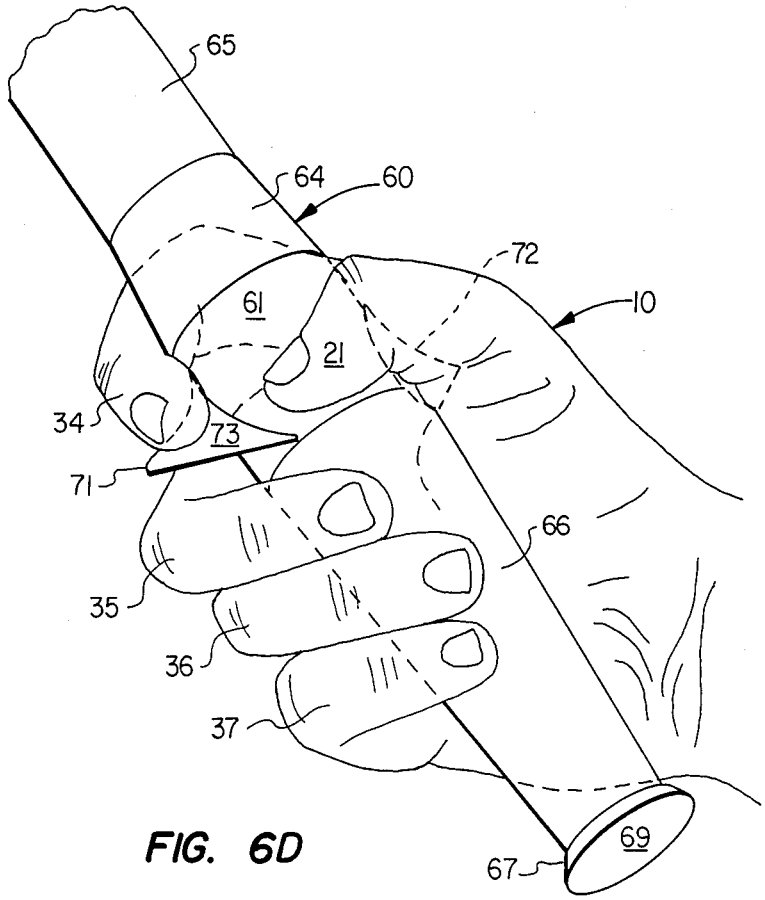
FIG. 6D shows an illustrative perspective view of the grip of the alternate embodiment of the invention illustrated in FIGS. 6A–6C being held by a hand in the power grip posture illustrating features thereof.

As shown in FIG. 6D, when the phalanged embodiment of the grip 60 is held by a hand 10 in the power grip posture, the uniform midsection 61 engages the region between the thumb and the index finger and the index finger wraps around the tapered upper transition region 64 and comes to rest with the ulnar portions of the digital pads of the index finger 34 resting on the superior surface 73 of the anterior phalange 71. Similarly, the inferior surface 76 of the posterior phalange 72 is engaged by the digital pads of the thumb 21 and the fleshy/pulpy area 40 between thumb 21 and index finger 34. For greater control over the rotational movement of the grip and incorporated into the basic grip design to counter rotational and torquing forces resulting from swinging motion of the implement 65 and/or gripping dynamics of the hand. The index phalange, i.e. the anterior phalange 71, permits the index finger 34 to hook the superior surface 73 of the grip at the very strategic location where the index finger 34 and thumb 21 oppose one another. Enhanced prehension is augmented due to the increased surface area of contact between the hand surface and the grip surface. Torquing of the grip is also reduced to increased angular control. The posterior phalange 72 is intended to distribute rotational and torquing forces to the tough tissue between the thumb and the index finger which is not as susceptible to injury and, which also increases the surface area of contact between the hand the grip to augment prehension at this particular location.

The subject grip of the present invention in each of its embodiments, serves to increase the contact area between the hand and the grip of an implement while providing maximum force bearing contact between less sensitive regions of the hand which are less susceptible to injury and restriction of vital tendons and arterial and nerve communications in the hand. In addition, the grip of the subject invention is rotationally symmetrical to provide the ability to rotate the implement within the hand to any desired modification of the power grip design such as in situations which call for a forehand and a backhand grip posture. The configuration of the subject grip additionally allows the fingers of the hand to be postured in a fashion so that the muscles are more nearly in the resting condition during grasping of the grip and, hence, will be able to exercise optimum force over the gripped object when called upon by the user. Finally, the subject grip design both maximizes the surface contact between the hand and the grip in regions which do not restrict blood flow to the hand so as to provide enhanced resistance to fatigue during use of the grip and at the same time maintain the hand wrist conjunction in a straight line so that the elements passing through the carpal tunnel of the hand remain straight and unrestricted. This leads to a lessening of fatigue during use of the hand and enhanced exercise of power and control over the gripped implement.

The above detailed description of the preferred embodiments of the invention is provided of way of example and various details of design and construction and implementation of the subject invention may be modified without departing from the true spirit and scope of the invention as se forth in the appended claims.

What is claimed is:

1. An improved grip for an implement to be used in the power grip posture of the human hand, comprising:

an elongate grip surface for engagement by the parts of the hand and including a generally uniform midsection for engaging the region between the thumb and the forefinger, said uiform midsection having a cross-sectional dimension to posture the thumb and the forefinger in opposition when wrapped about the handle, the length of said midsection being approximately equal to its cross-sectional dimension;

a generally upper tapering region transisting the cross section dimension from the uniform midsection to the diameter of the implement attached to the upper transition region; and a lower tapering region transisting from the uniform midsection and extending a distance sufficient to provide a surface for contact with the remaining fingers of the hand while the region between the thumb and the forefinger of the hand is in engagement with said midsection, said lower region tapering to a cross-sectional dimension smaller than that of the uniform midsection whereby the fingers when wrapped about the lower transition region are all postured with the muscles thereof near their resting lengths.

2. A structure as set forth in claim 1 wherein the grip also includes a radially extending phalange region affixed to the lower transition region to provide sensory tactical orientation for the heel of the hand with respect to the grip.

3. A grip as set forth in claim 1 wherein each of said sections are generally circular in cross section.

4. A grip as set forth in claim 1 wherein the cross-sectional dimension of the uniform midsection and the smallest cross-sectional dimension of the lower transition region are approximately in a ratio of 3-2.

5. A grip as set forth in claim 1 wherein the relationship of the length dimension of the uniform midsection to the length of the lower transition region is approximately 3-8.

6. An improved implement grip of the type adapted for being grasped by the human hand in a powergrip posture, wherein the improvement comprises means for receiving the fingers of the hand wrapped aboout said grip with the muscles of said hand near their resting lengths for affording the application of maximum force to be exercised over said grip by said hand, wherein said implement grip includes an elongate grip surface for engagement by the parts of the hand and including a generally uniform midsection for engaging the region between the thumb and the forefinger, said uniform midsection having a cross-sectional dimension to posture the thumb and forefinger in opposition when wrapped about the handle and a length approximately equal to its cross-sectional dimension, said grip surface including a generally upper tapering region transisting the cross-section dimension from the uniform mid-section to the diameter of the implement to be attached to the upper transition region, and said grip surface also including a lower tapering region transisting from said uniform midsection into a cross-sectional dimension permitting said muscles of said fingers wrapped thereround to be postured near their resting lengths, said lower tapering region having a length sufficient to provide a surface for contact with the remaining fingers of the hand while the region between the thumb and the forefinger of the hand is in engagement with said midsection.

7. The apparatus as set forth in claim 6 wherein maximum force bearing contact between said hand and said grip is porvided along a fleshy region between the thumb and index finger, said region being less sensitive and less susceptible to injury and restriction of vital tendons and arterial and nerve communications in the hand.

8. The apparatus as set forth in claim 6 wherein said means also includes a radially extending phalange region affixed to the lower transistion region to provide sensory tactical orientation for the heel of the hand with respect to the grip.

9. The apparatus as set forth in claim 6 wherin the cross-sectional dimension of the uniform midsection and the smallest cross-sectional dimension of the lower transition region are approximately in a ratio of 3-2.

10. The apparatus as set forth in claim 6 wherein the relationship of the length dimension of the uniform midsection to the length of the lower transition region is approximately 3-8.

* * * * *